US005113318A

United States Patent [19]

Conley

[11] Patent Number: 5,113,318

[45] Date of Patent: May 12, 1992

[54] THERMOSTAT LIGHT

[76] Inventor: David Conley, P.O. Box 450, Stillwater, N.Y. 12170

[21] Appl. No.: 565,280

[22] Filed: Aug. 9, 1990

[51] Int. Cl.[5] ..... F21V 21/14

[52] U.S. Cl. ..... 362/23; 362/157; 362/285; 362/418; 362/372

[58] Field of Search ..... 362/23, 157, 200, 226, 362/239, 248, 250, 251, 285, 288, 418, 410, 414, 362, 372

[56] References Cited

U.S. PATENT DOCUMENTS

| | | | |
|---|---|---|---|
| 1,367,879 | 2/1921 | Laird | 362/23 |
| 2,020,016 | 11/1935 | Brusseau | 362/23 |
| 2,100,241 | 11/1937 | Cunningham | 362/414 |
| 2,698,895 | 1/1955 | Olson | 362/23 |
| 2,816,213 | 12/1957 | McIntosh . | |
| 3,718,816 | 2/1973 | Seelbach et al. | 362/226 |
| 4,118,760 | 10/1978 | Cohon | 362/239 |
| 4,727,460 | 2/1988 | Payne | 362/269 |
| 4,772,986 | 9/1988 | McNemor . | |
| 4,882,667 | 11/1989 | Skegin | 362/408 |

*Primary Examiner*—Ira S. Lazarus
*Assistant Examiner*—Richard R. Cole
*Attorney, Agent, or Firm*—Schmeiser, Morelle & Watts

[57] ABSTRACT

The invention is a U-shaped lighting device that is adapted to be mounted about a home thermostat. The device includes a hood that surrounds a portions of the bulb for the purpose of directing the light toward the thermostat and away from the user's eyes. The bulb and hood can be moved from one side of the device to the other side of the device so that light can be shined on any portion of the thermostat. The light is battery powered and a push-button type switch is used to initiate lighting of the bulb.

20 Claims, 1 Drawing Sheet

THERMOSTAT LIGHT

FIELD OF THE INVENTION

The invention is in the field of lighting devices. More particularly, the invention is a battery powered light that can be mounted adjacent a control mechanism or similar instrument. The light includes a manual switch which a user can actuate to illuminate the instrument when required.

BACKGROUND OF THE INVENTION

Most homes have at least one wall mounted thermostat for automatically regulating the indoor temperature. The thermostat controls the home's furnace and sometimes is also used to control a central air conditioning unit. Within the thermostat is a temperature sensor which actuates an electrical switch at a user determined temperature. To adjust the temperature set point(s) at which the controlled appliance is turned on and off, the thermostat will normally include a dial type adjuster located on its front face or on one of its side edges.

For the most efficient sensing of the indoor temperature, the thermostat must be mounted in a location where it will sense the true room temperature and at the same time be unaffected by the outdoor temperature. This is normally accomplished by mounting the thermostat to one of the home's interior walls in a location that is spaced from any existing ducts, heating units or entryways.

A problem arises when the location that provides the thermostat with maximum effectiveness places it in an area where it is poorly illuminated. For example, a thermostat will often be mounted on a wall of an interior hallway. Most hallways are poorly lit since they are considered to be areas where reading or similar light intensive activities will not be performed. When the homeowner needs to adjust the thermostat, he or she finds that the poor lighting makes the numbers on the thermostat extremely hard to see. Even when the thermostat is located in a well lit room, the thermostat's numbers or controller can be hard to see if they are in a shadow caused by the thermostat structure itself, the design of the room, or placement of nearby room furniture. Poorly lit thermostats are the norm in mobile homes and many older homes.

There are a number of solutions to this problem that are available to the homeowner. The thermostat can be moved to a location where there is more available light. However, this can diminish the accuracy or effectiveness of the thermostat and require the rerouting of the wiring linking the thermostat to the controlled appliance. A second solution is to use a thermostat that includes a built-in light source. This solution requires a new, more expensive thermostat to be purchased and also, the installation of additional wiring to provide power for the light. A third solution is for the homeowner to use a flashlight whenever he or she needs to adjust the thermostat. This latter solution, while effective, is extremely inconvenient.

Therefore, there is a need for a device that can conveniently illuminate a standard thermostat no matter where the thermostat is located.

SUMMARY OF THE INVENTION

The invention is a lighting unit adapted to fit about a thermostat and provide illumination therefore. The unit includes a battery power source and a pushbutton type switch that enables the user to operate the light whenever it is needed. Illumination is provided by a flashlight type bulb that is connected in series with the power source and switch. The bulb is housed within a clamshell shaped hood that functions to direct the light only at the thermostat and thereby prevents light from shining directly into the user's eyes.

The invention includes a number of features that make it adaptable to fit most common types of thermostats. It is adjustable in width so that it can fit around a basic small thermostat or be expanded to fit around a large rectangular programmable-type thermostat. The hood and bulb are movable from one side of the device to an opposite side of the device to enable the illumination of any portion of the thermostat. This feature allows the light to be used on thermostats in which the adjustment controls are located on either its top surface, its front face or one of its sides. For thermostats that have the adjustment controls located on a bottom surface, the lighting device can be placed below the thermostat in a position where the light is directed to shine upwardly on the controls.

DETAILED DESCRIPTION OF THE DRAWINGS

Figure 1:
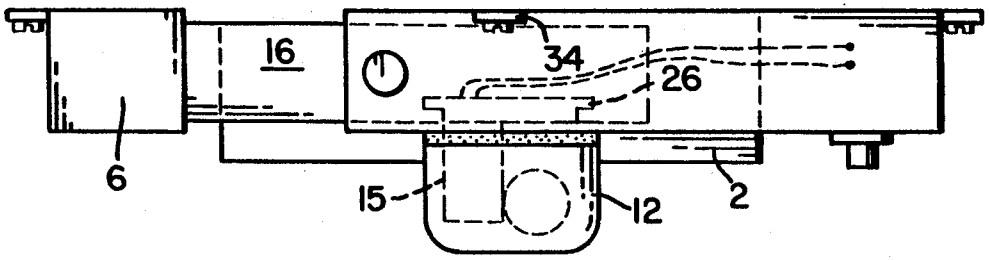
FIG. 1 is a plan view of the invention located adjacent to a standard thermostat.
Figure 2:
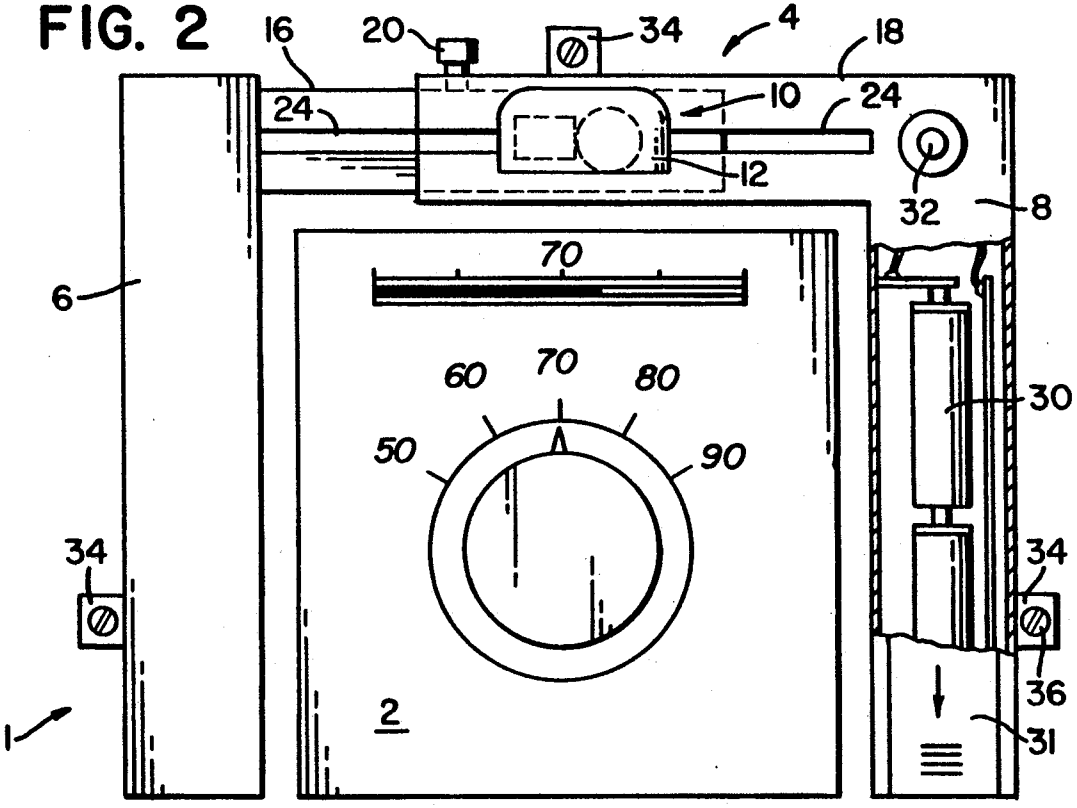
FIG. 2 is an elevation view of the invention and thermostat shown in FIG. 1.
Figure 3:
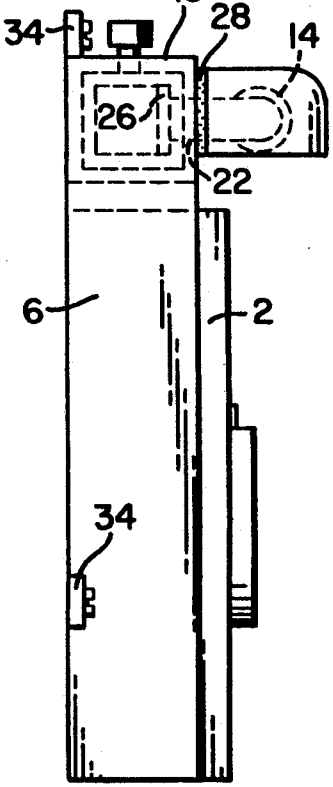
FIG. 3 is a side view of the invention and thermostat shown in FIG. 1.

Referring now to the drawings in greater detail, wherein like reference characters refer to like parts throughout the several figures, there is shown by the numeral 1 a light unit mounted about the top and sides of a thermostat 2.

The light unit consists of a top portion 4 and two depending leg portions 6 and 8. At the front of the top portion is a light assembly 10 that includes a hood 12, a bulb 14 and a bulb socket 15. The bulb socket has internal threads that engage and support the base of the bulb. The hood extends outwardly approximately one-half inch to one inch from the front surface of the top portion and surrounds the top and sides of the bulb. This placement of the hood causes the bulb's illumination to be directed downwardly toward the thermostat.

Each of the vertical leg portions 6 and 8 has a square cross-section measuring approximately one inch by one inch. At the top of each leg is a horizontally oriented member 16 and 18 respectively. The two horizontal members engage each other in sleeve fashion with member 16 fitting within member 18. The two members together form the top portion 4 of the device. A lockscrew 20 is threadedly engaged to member 18 and presses down on a top surface of member 16. The lockscrew is used to adjustably lock the two horizontal members together. Loosening of the lockscrew allows the two members to slide relative to each other so that the width of the device can be changed from approximately four to approximately seven inches.

The light assembly 10 is slidably mounted to the top portion 4 and includes a rectangular portion 22 that extends rearwardly from the bulb socket 15. The rectangular portion 22 engages a slot 24 that is located on the front side of both horizontal members 16 and 18. A plate shaped member 26 having a vertical dimension greater than that of the slot 24 is located at the rear end of portion 22 to prevent its disengagement from the slot. A foam washer 28 encircles an inner end of portion 22 and is shown in FIG. 1 being sandwiched between the rear of the hood and the front surface of horizontal member 18. It should be noted that when the light assembly is moved to the far left, the washer will be sandwiched between the front surface of horizontal member 16 and the rear of the hood. The washer functions to provide a spring effect when pushing inwardly on the hood. This additional axis of allowed movement for the light assembly is required to compensate for the different wall thicknesses about slot 24. As shown in FIG. 1, a single wall thickness surrounds the left end of the slot and a double wall thickness surrounds the right end of the slot. The use of a foam washer allows the hood to be pushed inwardly and to then be slid from one end of the slot to the other end of the slot without the side of the plate member being obstructed by the end of member 16. Once the light assembly is in the desired position, the hood is released and the spring biasing due to the washer forces the hood outwardly thereby causing the plate member to firmly engage the interior wall portion surrounding the slot.

To power the light, two "AA"—size batteries 30 are located in leg portion 8 and are oriented end-to-end. A slidable panel 31 (partially shown) is located at the base of the leg portion to provide accessibility to the battery compartment. The batteries are wired in series to the bulb socket 15 and to a front mounted push-button type switch 32. The bulb socket includes internal contacts which electrically connect the bulb to the wiring leading to the bulb socket. Manual actuation of the switch causes the circuit to become closed and the bulb to light.

Ears 34 are located along the device's perimeter to facilitate mounting of the device about a thermostat. Each ear includes a center aperture which can receive a screw 36 or similar fastener. It should be noted that other methods of mounting the device (i.e.—tape, adhesives, etc.) can be employed.

To mount the device, the first step is to loosen the lockscrew 20 until both leg portions 6 and 8 can be moved relative to each other. Next, the unit is placed about the thermostat with the top portion 4 located one to three inches above the top of the thermostat. The leg portions of the device are then moved inwardly until they closely bracket the thermostat. At this point, the location of the thermostat controls are checked to make sure that there will be sufficient accessibility once the lighting unit is secured in place. The leg portions are moved outwardly if required and then the lockscrew 20 is tightened. Next, the fasteners are positioned in the ears 34 and the light is secured to the wall or other support surface adjacent the thermostat. The device is now ready to be used.

For a thermostat which has controls located at its base, the lighting device can be mounted about the bottom of the thermostat (i.e.—the device is rotated 180 degrees so that the light is directed upwardly). In this position, the bottom of the thermostat is fully illuminated. It should also be noted that the lighting unit can be installed 90 degrees from the position shown in the figures and thereby aim the light directly at either side of the thermostat.

Operation of the device is simple. Whenever light is required to read the thermostat's thermometer or to adjust its controls, the user merely presses button 32 with one finger. In the preferred embodiment, the button is of the type whereby the light will stay on only as long as the button is depressed. An alternate embodiment would employ a toggle-type switch that requires two separate motions to turn it on and then off. For the latter embodiment, the light once turned on will remain on for as long as needed without requiring continual contact with the switch. When light is no longer needed, the light switch is returned to its "off" position.

The primary usage envisioned for the invention is to provide illumination for a common thermostat. The invention can also be used to light other types of mounted instruments or devices in which numbers are required to be read in low light conditions. Using a different type of fastening system, the device can be placed on an air conditioner's thermostat. For the latter usage, the preferred fastening method is to employ doublestick tape on the back of the device and to mount the device atop the air conditioner's control panel.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A lighting device comprising:

a base structure having a front face;

a light means movably attached to said base structure wherein said light means is capable of being moved in a linear path along a portion of said front face;

a hood means attached to said light means in a position wherein it partially covers said light means and is capable of directing at least a portion of any light emitted from said light means in a direction substantially parallel to said front face;

a power source means comprising at least one battery mounted to said base structure and connected to said light means;

a switch means attached to said base structure and connected to said light means wherein said switch means is operable to allow energy from said power source means to reach said light means and thereby cause said light means to emit light energy; and attachment means connected to said base structure for attaching said base structure to a support surface proximate an instrument.

2. The device of claim 1 wherein said base structure has a first end and a second end and includes means for adjusting the distance between said ends.

3. The device of claim 1 wherein said base structure includes:

an elongated center portion having a first end and a second end;

a first depending portion located at said first end;

a second depending portion located at said second end; and a battery compartment located in said first depending portion for housing said at least one battery.

4. A lighting device comprising:

a base structure having a front face, a first end, a second end and means for adjusting the distance between said first and second ends;

a light means movably attached to said base structure wherein said light means is capable of being moved in a linear path along a portion of said front face;

a hood means attached to said light means in a position wherein it partially covers said light means and is capable of directing at least a portion of any light emitted from said light means in a direction substantially parallel to said front face;

a power source means mounted to said base structure and connected to said light means;

a switch means attached to said base structure and connected to said light means wherein said switch means is operable to allow energy from said power source means to reach said light means and thereby cause said light means to emit light energy; and attachment means connected to said base structure for attaching said base structure to a support surface proximate an instrument.

5. The device of claim 4 wherein said length adjusting means comprises two members which are telescopically engaged and which form said base structure.

6. The device of claim 5 further comprising a lock means attached to at least one of said two members for locking the two members together.

7. The device of claim 4 wherein said light means is movably attached to said base structure by an attachment means comprising an extension means located on a rear portion of said light means and wherein said extension means is slidably received within a slot means located on said front face of said base structure.

8. The device of claim 7 wherein said attachment means for said light means also allows said light means to be moved in a direction substantially perpendicular to the front face of said base structure.

9. The device of claim 8 wherein said attachment means for said light means further comprises a resilient biasing means attached to said extension means for biasing said attachment means in a direction toward a rear face of said base structure.

10. The device of claim 9 wherein said resilient biasing means is a washer made from a resilient material.

11. The device of claim 10 wherein said resilient material is foam material.

12. The device of claim 4 wherein said power source means comprises at least one battery.

13. The device of claim 12 wherein said base structure includes:

an elongated center portion having a first end and a second end;

a first depending portion located at said first end;

a second depending portion located at said second end; and a battery compartment located in said first depending portion for housing said at least one battery.

14. The device of claim 4 wherein said switch means functions in a manner whereby energy is allowed to pass to said light means only when an operator is actuating said switch means.

15. The device of claim 4 wherein said switch means is a pushbutton type switch.

16. A lighting device comprising:

an elongated base member;

a slot means extending across a front portion of said base member, said slot means having two spaced ends;

a slidable bulb mounting means, said mounting means including a rear portion that is slidable received in said slot means and wherein said rear portion can be moved from one of said ends of said slot means to the other of said ends of said slot means;

a light bulb located in said bulb mounting means;

a hood means attached to said bulb mounting means and which surrounds at least a portion of said light bulb;

a battery pack means connected to said base member;

a switch means connected to said base member;

electricity transmission means which electrically connect said bulb, switch means and battery pack means; and fastening means attached to said base member for mounting said base member to a support surface.

17. The device of claim 16 wherein said battery pack means is located within a member which depends from an end of said base member.

18. The device of claim 16 further comprising means for adjusting the length said base member whereby said adjustment means also functions to adjust the distance between the two spaced ends of said slot means.

19. The device of claim 18 wherein said base member has a first end and a second end and a depending member is located at each of said ends of said base member.

20. The device of claim 19 wherein the depending members are spaced from each other by a distance which allows the device to be mounted adjacent a thermostat with the two depending members located adjacent a pair of opposite side edges of said thermostat.

* * * * *